US006310331B1

(12) United States Patent
Nance et al.

(10) Patent No.: US 6,310,331 B1
(45) Date of Patent: Oct. 30, 2001

(54) CIRCUIT CONFIGURATION FOR DRIVING AN IGNITION COIL

(75) Inventors: Paul Nance; Peter Sommer, both of München; Jenoe Tihanyi, Kirchheim; Ludwig Leipold, München, all of (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/633,708

(22) Filed: Aug. 7, 2000

(30) Foreign Application Priority Data

Aug. 5, 1999 (DE) ..... 199 37 055

(51) Int. Cl.[7] ..... H05B 1/02

(52) U.S. Cl. ..... 219/497; 219/491; 219/501; 219/519; 307/117

(58) Field of Search ..... 219/497, 494, 219/490–491, 499, 501, 505, 518, 519; 307/117

(56) References Cited

U.S. PATENT DOCUMENTS

| | | | | |
|---|---|---|---|---|
| 4,897,528 | * | 1/1990 | Anthony | 219/497 |
| 5,321,231 | * | 6/1994 | Schmalzriedt et al. | 219/497 |
| 5,463,874 | * | 11/1995 | Farr | 62/126 |
| 6,166,927 | * | 12/2000 | Farrington et al. | 363/25 |

* cited by examiner

*Primary Examiner*—Mark Paschall
(74) *Attorney, Agent, or Firm*—Herbert L. Lerner; Laurence A. Greenberg; Werner H. Stemer

(57) ABSTRACT

A circuit configuration for driving an ignition coil includes a first semiconductor switch having a load path connected in series with a primary winding of the ignition coil, and having a control electrode, which is driven in accordance with a first drive signal. The circuit configuration further includes a second semiconductor switch having a load path connected in parallel with the primary winding and having a control electrode, which is driven in accordance with a second drive signal.

19 Claims, 3 Drawing Sheets

CIRCUIT CONFIGURATION FOR DRIVING AN IGNITION COIL

BACKGROUND OF THE INVENTION

Field of the Invention

The present invention relates to a circuit configuration for driving an ignition coil, which is for example used for generating ignition sparks in spark-ignition engines.

Circuit configurations of this type have a semiconductor switch having a load path connected in series with a primary winding of the ignition coil, and having a control electrode for driving the semiconductor switch in accordance with a drive signal. In this case, the series circuit formed by the semiconductor switch and the primary winding is connected to terminals for a voltage supply.

If, in circuit configurations of this type, the semiconductor switch is closed in dependence of the drive signal, a current which rises over time flows through the primary winding. When the semiconductor switch is subsequently opened, the energy stored in the primary winding is transferred to a secondary winding of the ignition coil, in order to generate an ignition spark at a spark plug connected thereto.

The instant at which the ignition spark is generated or the semiconductor switch is opened is prescribed for the circuit configuration externally, depending on the engine data. Consequently, the period of time between the closing and opening of the first semiconductor switch may vary.

After the closing of the semiconductor switch, and thus the beginning of energy storage in the primary winding, circumstances can occur which should be avoided, such as, for example, an excessive heating of the circuit configuration.

SUMMARY OF THE INVENTION

It is accordingly an object of the invention to provide a circuit configuration for driving an ignition coil which overcomes the above-mentioned disadvantages of the heretofore-known circuit configurations of this general type and which, in particular prevents excessive heating of the circuit configuration, and which allows the semiconductor switch to be opened for the purpose of limiting the current through the primary winding, in particular such that, when the semiconductor switch is opened in these cases, the generation of an ignition spark can be prevented.

With the foregoing and other objects in view there is provided, in accordance with the invention, a circuit configuration, in particular in combination with an ignition coil, for driving the ignition coil, the circuit configuration including:

- a first semiconductor switch having a first load path to be connected in series with a primary winding of an ignition coil and having a first control electrode for driving the first semiconductor switch in accordance with a first drive signal; and
- a second semiconductor switch having a second load path to be connected in parallel with the primary winding and having a second control electrode for driving the second semiconductor switch in accordance with a second drive signal.

In other words, the circuit configuration according to the invention provides an additional, second semiconductor switch having a load path connected in parallel with the primary winding, and having a control electrode for a driving in accordance with a second drive signal.

The second semiconductor switch, which is configured in particular as an insulated gate bipolar transistor or as a field-effect transistor, takes over, as long as it is held in the on state (conducting state) by the second drive signal, the current through the primary coil if the first semiconductor switch is in the off state or the conductivity thereof decreases. The second semiconductor switch is connected in the reverse direction between that terminal of the primary winding which is remote from the first semiconductor switch and the other terminal of the primary winding and, in this case, acts like a controlled freewheeling diode. The second semiconductor switch is conducting only in the direction between a node common to the primary winding and to the first semiconductor switch and the other terminal of the primary winding and is non-conducting (off state) in the other direction. The second semiconductor switch is in the on state, given a positive supply potential, when, if the first semiconductor switch is in the off state, the potential at the node which is common to the primary winding and to the first semiconductor switch rises above the value of a supply potential to which the other terminal of the primary winding is connected. If the second semiconductor switch is in the off state as well as the first semiconductor switch, the energy previously stored in the primary winding is transferred to the secondary coil, and an ignition spark is generated at the ignition coil connected on the secondary side.

One embodiment of the invention provides for the circuit configuration to have a first control circuit connected to a control electrode of the first semiconductor switch, for driving the first semiconductor switch depending on a current through the primary winding and/or the first semiconductor switch. After the closing of the first semiconductor switch, this control circuit detects the current through the primary winding and/or the current through the first semiconductor switch. If this current exceeds a prescribed value, the first semiconductor switch is opened by the first control circuit. The second semiconductor switch then accepts the current from the primary winding until the current has fallen, due to line resistances and the first semiconductor switch switches on again. The current through the primary winding and/or the first semiconductor switch is thus adjusted to a prescribable value by alternately switching on and off or alternately down-regulating and up-regulating of the first semiconductor a switch, and, respectively, the current fluctuates around the prescribable value.

The control electrodes of the first and second semiconductor switches are preferably connected to an input terminal of the circuit configuration to which a drive signal is fed, in accordance with which the ignition spark is generated. As long as no ignition spark is intended to be generated, the first and second semiconductor switches are held in the on state, in which case the first semiconductor switch can occasionally be turned off by the first control circuit for the purpose of regulating the current through the primary winding. In order to avoid the generation of an ignition spark, the current through the primary winding is then taken over by the second semiconductor switch, acting as a freewheeling diode, until the first semiconductor switch is in the on state again. If an ignition spark is intended to be generated, the drive signal causes both semiconductor switches to be turned off, once the primary winding has taken up current.

In accordance with another feature of the invention, the first control circuit has a third semiconductor switch, which is connected between the control electrode of the first semiconductor switch and a reference-ground potential and can be driven in accordance with a current measurement signal dependent on a current through the first semiconductor switch. In order to provide the current measurement signal, a current sensing resistor is preferably provided, which is connected between a load path terminal of the first semiconductor switch and a reference-ground potential, wherein a control electrode of the third semiconductor switch, for feeding in the current measurement signal, is connected to a terminal of the current sensing resistor.

The first and second semiconductor switches are preferably configured as transistors, in particular as insulated gate bipolar transistors or as field-effect transistors.

A further embodiment of the invention provides for a measurement according to the current sensing principle, in order to provide the current measurement signal. In this case, in addition to the first semiconductor switch configured as a transistor, a further transistor is provided, whose control electrode is connected to the control electrode of the first transistor and which is connected by a first load path terminal thereof to a first load path terminal of the first transistor. The current sensing resistor for providing the current measurement signal is connected downstream of a second load path terminal of the further transistor.

According to a further embodiment of the invention a second control circuit is provided for driving the first semiconductor switch depending on a temperature in the circuit configuration. If the temperature in the circuit exceeds a prescribed value, the first semiconductor switch is closed and thus prevents a further rise in the current through the primary winding. The second semiconductor switch takes over the current through the primary winding and thus prevents the generation of an ignition spark. The second control circuit preferably has a further semiconductor switch, which is connected between the control electrode of the first semiconductor switch and the reference-ground potential and which is driven in accordance with a temperature signal provided by a temperature sensor.

Preferably, the first semiconductor switch is integrated with the first and/or second control circuit in a first chip or semiconductor body, while the second semiconductor switch is integrated in a second chip or semiconductor body. The two chips are preferably soldered onto a common support, for example a copper block, and are accommodated in a common housing.

Although the invention is illustrated and described herein as embodied in a circuit configuration for driving an ignition coil, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

In the figures of the drawings, unless indicated otherwise, identical reference symbols designate identical structural parts and functional units with the same meaning.

The invention is explained below using transistors as semiconductor switches. In the case of insulated gate bipolar transistors and field-effect transistors, the gate electrodes thereof are the control electrodes, and the drain and source electrodes thereof are the load path terminals.

Figure 1:
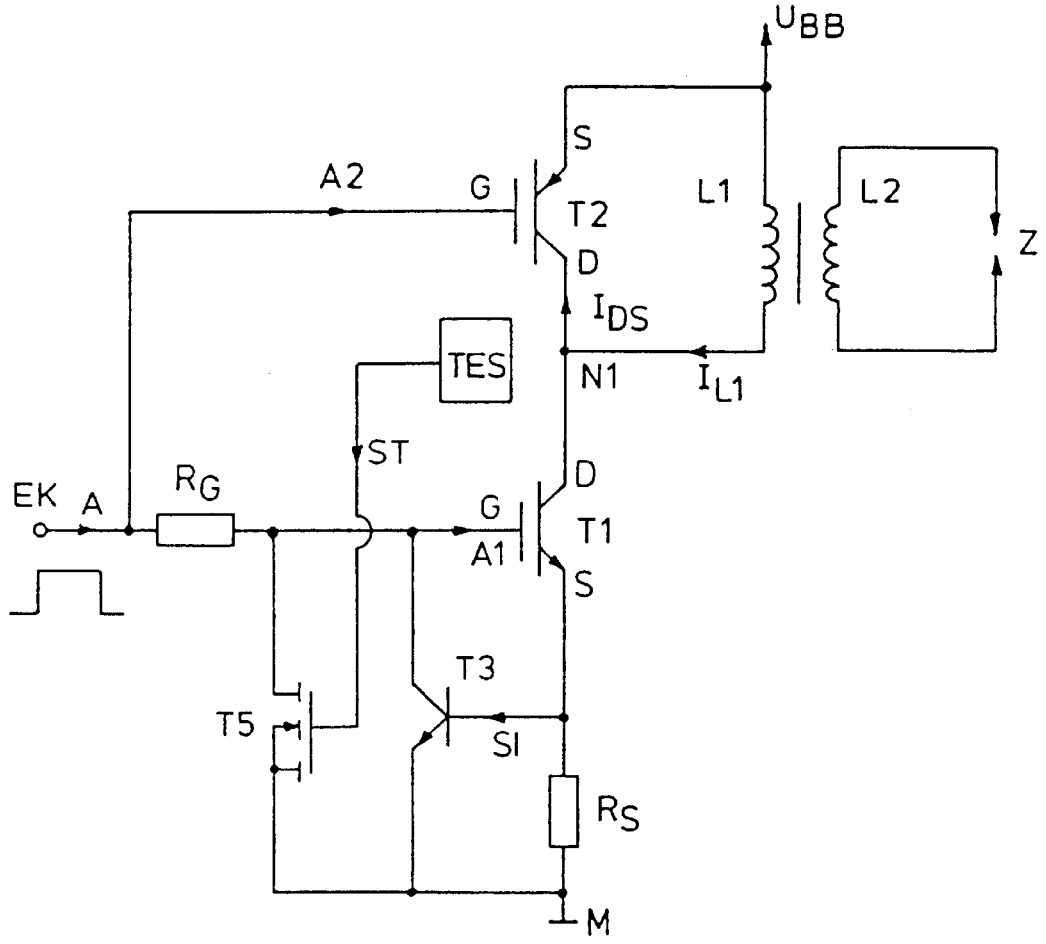
FIG. 1 is a circuit diagram of a circuit configuration according to a first embodiment of the invention.

A first embodiment of the circuit configuration according to the invention is illustrated in FIG. 1. The circuit configuration has an ignition coil with a primary winding L1 and a secondary winding L2, a spark plug Z for generating an ignition spark being connected in parallel with the secondary winding L2. A first connecting terminal of the primary winding L1 is connected to a terminal for supply potential $U_{BB}$. In order to switch a current through the primary winding L1, a first semiconductor switch T1 is provided, which is configured as an n-conducting insulated gate bipolar transistor in the example and is connected by a drain terminal to a second terminal of the primary winding L1.

The first transistor T1 can be driven as a function of a first drive signal A1, which is fed to its gate electrode G. In the exemplary embodiment, the gate electrode G of the first transistor T1 is connected via a resistor $R_G$ to an input terminal EK, to which a drive signal A is fed as a function of which the ignition spark is generated. The resistor $R_G$ serves for limiting the current to the gate electrode G.

Connected in parallel with the primary winding L1 of the ignition coil is a load path D–S of a second semiconductor switch T2 which, in the exemplary embodiment, is configured as an insulated gate bipolar transistor and can be driven in accordance with a second drive signal A2. In the exemplary embodiment, the gate electrode G of the second transistor T2 is connected directly to the input terminal EK of the circuit configuration, its source electrode S is connected to the terminal for a supply potential $U_{BB}$, and its drain electrode D is connected to a node N1, which is common to the first transistor T1 and to the primary winding L1.

Moreover, in order to drive the first semiconductor switch T1, a first control circuit T3, $R_S$ is provided, which, in the exemplary embodiment, has a third semiconductor switch T3, which is configured as an npn bipolar transistor, is connected between the control electrode G of the first semiconductor switch T1 and a reference-ground potential M and can be driven in accordance with a current measurement signal SI which is dependent on a current through the first semiconductor switch T1. In order to provide the current measurement signal SI, a current sensing resistor $R_S$ is connected between the source terminal S of the first transistor T1 and the reference-ground potential M, a base terminal B of the transistor T3 being connected to a node which is common to the resistor $R_S$ and to the first semiconductor switch T1.

A second control circuit T5, TES serves for driving the first semiconductor switch T1 depending on a temperature in the circuit configuration. In the example, the second control circuit has a further semiconductor switch T5, which is configured as an n-channel FET and whose load path D–S is connected between the gate electrode G of the first transistor T1 and the reference-ground potential M and which can be driven in accordance with a temperature signal ST provided by a temperature sensor TES, the gate electrode G of the n-channel FET T5 being connected to a terminal of the temperature sensor TES.

The circuit configuration described above and illustrated in the drawings functions in the manner described below.

Figure 4:
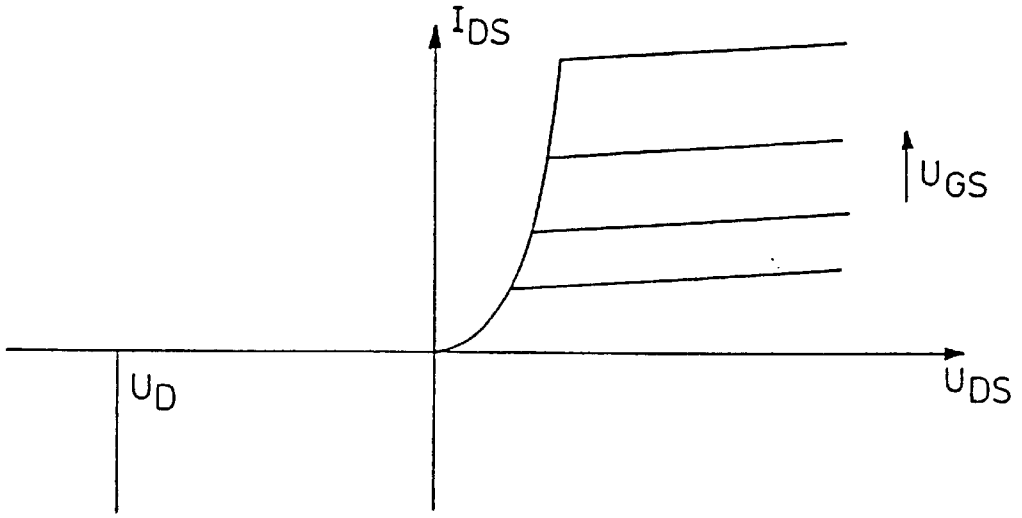
FIG. 4 is a graph illustrating a family of characteristic curves of the second semiconductor switch.

In order to turn the first and second semiconductor switches T1, T2 on, the drive signal A assumes an upper signal level whose value, for the exemplary embodiment illustrated in FIG. 1, is chosen such that it lies above the value of the supply potential $U_{BB}$, so that a positive gate-source voltage is applied to the second transistor T2. In this case, the resistor $R_G$ protects the gate electrode G of the first transistor T1 against an excessively large voltage. When the first transistor T1 is turned on, in other words, when the first transistor is in a conducting state, a current $I_{L1}$ which rises with time starts to flow via the primary winding L1 of the ignition coil. The potential at the node N1 which is common to the drain electrodes D of the first and second transistors T1, T2 is less than the supply potential $U_{BB}$. The drain-source voltage $U_{DS}$ between the drain electrode D and the source electrode S of the second transistor T2 is thus negative. In this case, no current flows via the drain-source path D-S as long as the absolute value of the voltage present across the second transistor T2 in the reverse direction is lower than a breakdown voltage $U_D$ of the second semiconductor switch T2, as can be seen from the family of characteristic curves of an insulated gate bipolar transistor of this type, which is illustrated by way of example in FIG. 4 and in which the drain-source current $I_{DS}$ is plotted against the drain-source voltage $U_{DS}$ for rising gate-source voltages. The second transistor T2 is chosen such that the absolute value of its breakdown voltage $U_D$ is larger than a maximum positive voltage present between the source electrode S and the drain electrode D, in order to ensure that in the case of a negative drain-source voltage $U_{DS}$, that is to say when the first transistor T1 is in the on state and the supply potential $U_{BB}$ is greater than the potential at the node N1, the second transistor T2 is reliably in the off state.

If the first transistor T1 is in the off state or the conductivity behavior thereof decreases because the third transistor T3 or the transistor T4 is in the on state, the potential at the node N1 rises until the drain-source voltage of the second transistor T2 becomes positive and the second transistor T2 accepts all or part of the current $I_{L1}$ flowing via the primary winding L1. This prevents the energy stored in the primary winding L1 from being transferred to the secondary winding L2 in order to generate an ignition spark there. In this way, the second transistor T2 acts like a freewheeling diode, the second transistor T2 being in the on state only as long as a positive potential is present at its gate electrode, that is to say as long as the drive signal A assumes an upper signal value.

The third transistor T3 is in the on state if the current through the load path D-S of the first transistor T1 causes, across the current sensing resistor $R_S$, a voltage whose value corresponds to the value of the base-emitter voltage, at which the third transistor T3 is in the on state.

As a consequence, the first transistor T1 effects a down-regulation, as a result of which the current through the primary winding L1 does not rise any further, the second transistor T2 takes over at least part of the current flowing via the primary winding L1, the voltage across the current sensing resistor $R_S$. thereby decreases and the third transistor starts to turn off again. Due to the regulating operation described, in which the first transistor T1 alternately opens and closes or is in the on state alternately to a greater or lesser extent, the current $I_{L1}$ through the primary winding L1 is adjusted to a prescribable value, thereby preventing the circuit configuration from being heated to an excessively great extent.

If the drive signal A changes over from the upper signal level to a lower signal level at which neither the first nor the second transistor T1, T2 is in the on state, the energy stored in the primary winding is transferred to the secondary winding and an ignition spark is generated at the spark plug connected thereto.

If the temperature in the circuit configuration, the temperature being detected by the temperature sensor TES, exceeds a prescribable value, the transistor T5 is turned on by the temperature signal ST and thus turns the first semiconductor switch T1 off. If the drive signal A is at the upper signal level, at which an ignition spark is not intended to be generated, the second transistor T2 is in the on state and takes over the current through the primary winding L1, thereby preventing the generation of an ignition spark. Due to line resistances, the current $I_{L1}$ through the primary winding L1 and/or the second semiconductor switch T2 decreases rapidly, which means that even in the event of both semiconductor switches T1, T2 subsequently being closed, an ignition spark cannot be generated.

Figure 2:
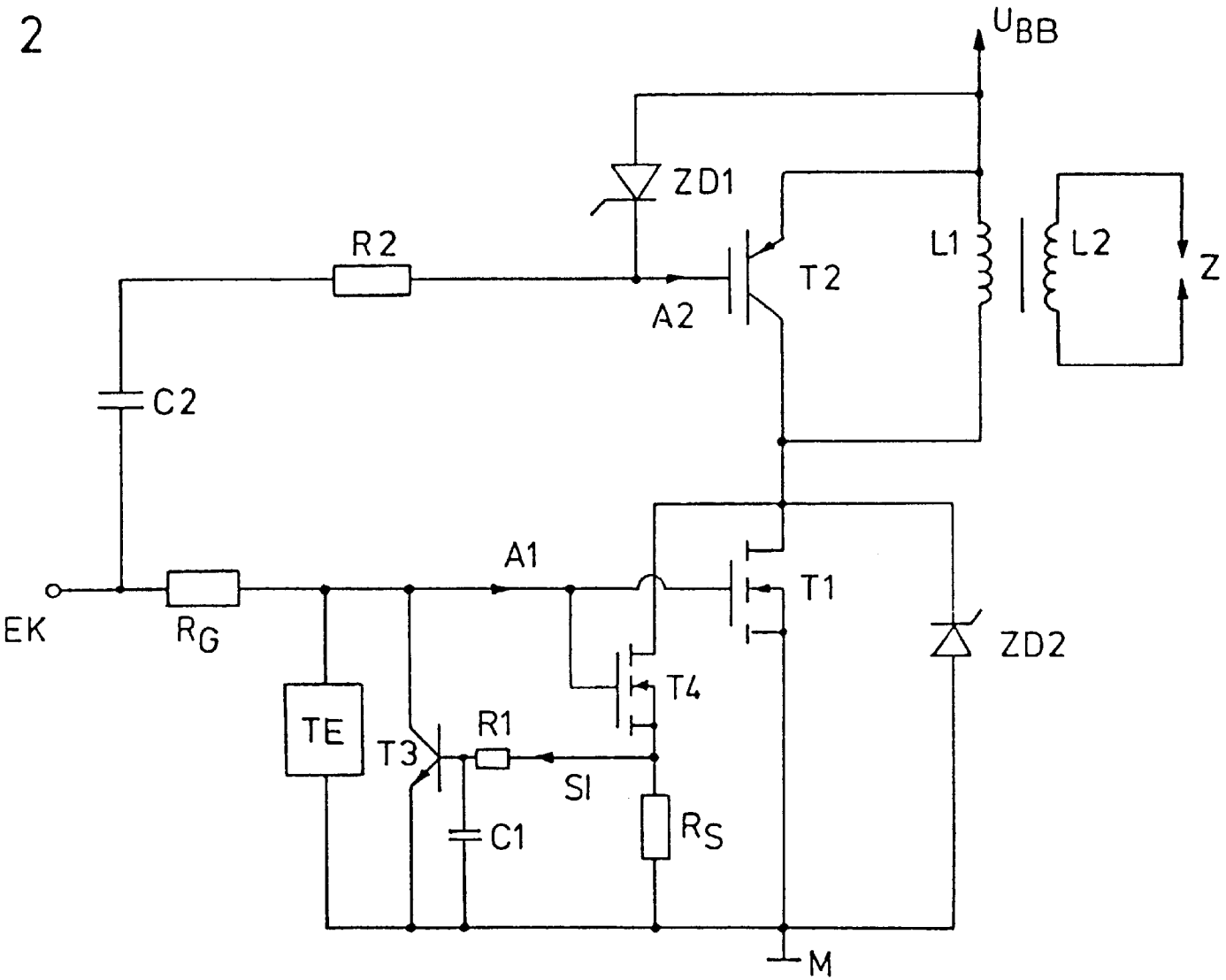
FIG. 2 is a circuit diagram of a circuit configuration according to a second embodiment of the invention, with a current measurement according to the current sensing principle.

A further embodiment of the circuit configuration according to the invention is illustrated in FIG. 2, where a field-effect transistor T1 is used as the first transistor, a zener diode D2 being connected in parallel with the field-effect transistor as protection against overvoltage. In order to detect the current through the first transistor T1, a measurement transistor T4 is provided in the form of a further field-effect transistor whose gate electrode G is connected to the gate electrode G of the first transistor T1 and whose drain electrode D is connected to the drain electrode D of the first transistor T1. As a result, the transistors T1 and T4 are operated at the same operating point; the ratio of the currents via the load paths D-S of these transistors T1, T4 corresponds to the area ratio thereof, the measurement transistor T4 being configured to have a significantly smaller area than the first transistor T1 and, therefore, taking up only a fraction of the load current of the first transistor T1 as measurement current. Connected downstream of the measurement transistor T4 is a current sensing resistor $R_S$ for converting the measurement current into a current measurement signal SI for driving the third transistor T3.

Connected between the gate electrode of the first transistor T1 and the reference-ground potential M is a temperature-dependent switch TE for turning the first transistor T1 off in the event of overtemperature of the circuit configuration.

In order to drive the second transistor, a bootstrap circuit is provided in the exemplary embodiment according to FIG. 2. The bootstrap circuit has a zener diode ZD1, connected between the terminal for supply potential $U_{BB}$ and the gate electrode G of the second transistor T2, and a capacitor C2, connected between the gate electrode G of the second transistor T2 and the input terminal EK, a resistor preferably being connected in series with the capacitor. If the drive signal A assumes a lower signal level, preferably reference-ground potential M, the capacitor C2 is charged to supply potential $U_{BB}$ via the zener diode ZD1; the second transistor T2 remains turned off in the process. If the drive signal A subsequently assumes an upper signal level, the charge on the capacitor C2 is preserved and the potential at the gate electrode G of the second transistor T2 rises to the value of the supply potential $U_{BB}$ plus the value of the upper signal level of the drive signal A. The second transistor T2 is turned on. The embodiment with a bootstrap circuit has the advantage that the drive signal A at the input terminal EK does not have to be made available in the form of a signal which is greater than the supply potential $U_{BB}$ in order to turn the second transistor T2 on. In this case, what suffices as the upper signal level is a signal which corresponds to the gate-source voltage, at which the second transistor is in the on state. This signal also suffices to turn the first transistor T1 on.

In the exemplary embodiment, a resistor R1 is connected upstream of the base of the third transistor T3; a capacitor C1 is connected in parallel with the base-emitter path of the transistor T3.

Figure 3:
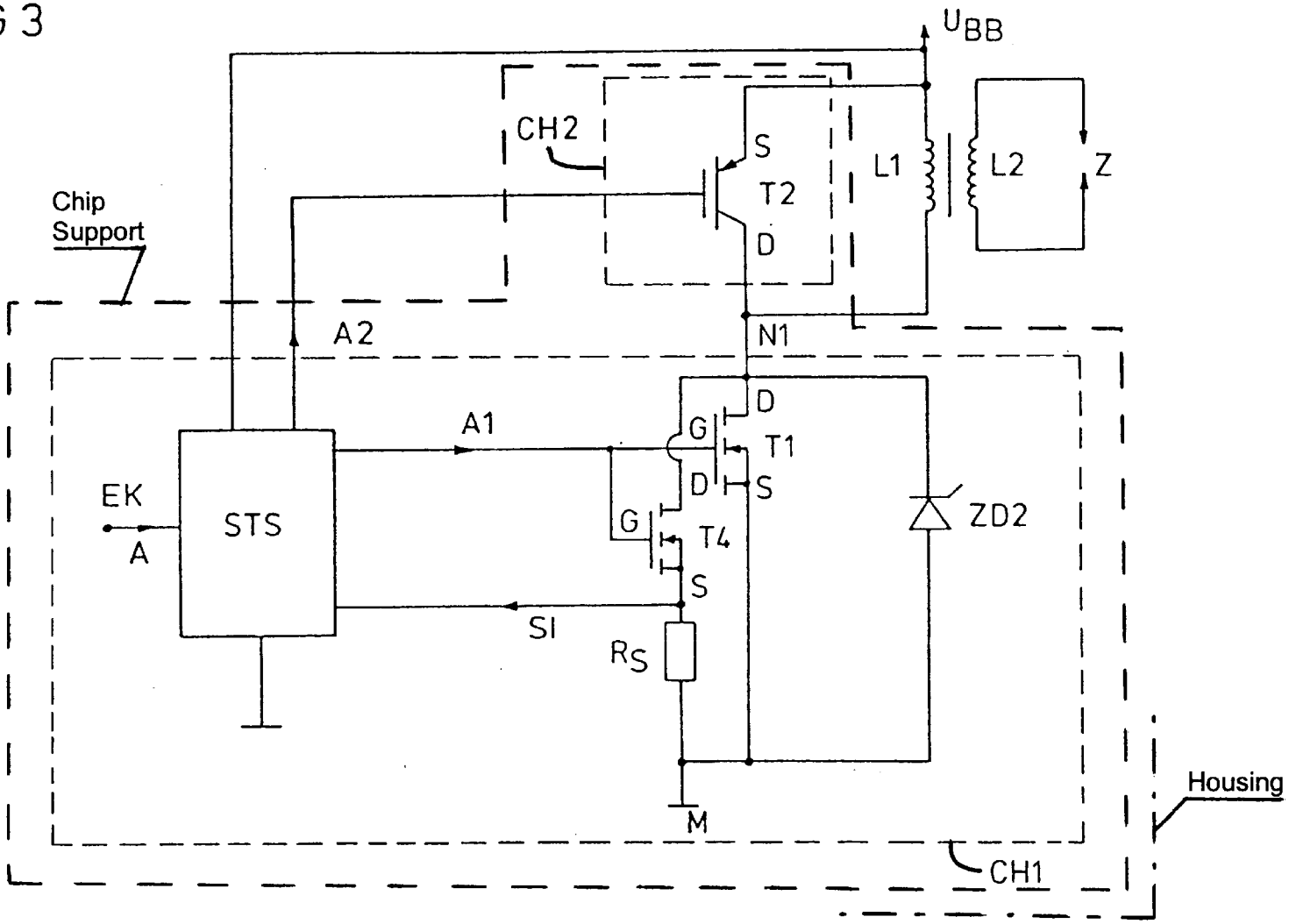
FIG. 3 is a circuit diagram of a circuit configuration according to a further embodiment of the invention, with the first and second semiconductor switches being integrated in a first and a second chip, respectively.

FIG. 3 shows a further embodiment of the circuit configuration according to the invention, where, in order to evaluate the current measurement signal SI and in order to drive the first transistor T1, a circuit STS is present, in which, by way of example, a device for temperature monitoring is also integrated. The driving of the first transistor T1 through the use of the circuit STS can be effected for example by the generation of the first drive signal A1 taking account of the drive signal A present at an input of the circuit STS, the current measurement signal SI and a temperature signal generated internally. The second drive signal A2 is likewise generated by the circuit STS taking account of the drive signal A.

As is indicated by dashed lines in FIG. 3, the first semiconductor switch T1 and the control circuits provided for driving it, like the first and second control circuits in FIGS. 1 and 2, and/or the circuit STS are preferably integrated in a first chip CH1. The second transistor T2 is integrated in a second chip. The two chips CH1, CH2 are preferably soldered onto a common support, for example a copper block, which is schematically indicated by a dashed line in FIG. 3. The chips CH1, CH2 are preferably accommodated in a common housing which is indicated by a dash-dotted line in FIG. 3.

We claim:

1. In combination with an ignition coil having a primary winding, a circuit configuration for driving the ignition coil, comprising:

a first semiconductor switch having a first load path connected in series with the primary winding and having a first control electrode for driving said first semiconductor switch in accordance with a first drive signal; and a second semiconductor switch having a second load path connected in parallel with the primary winding and having a second control electrode for driving said second semiconductor switch in accordance with a second drive signal.

2. The circuit configuration according to claim 1, including a control circuit for driving said first semiconductor switch in dependence of a current through at least one of the primary winding and said first semiconductor switch, said control circuit being connected to said first control electrode.

3. The circuit configuration according to claim 2, wherein said control circuit includes a third semiconductor switch connected between said first control electrode and a reference-ground potential, and said third semiconductor switch is drivable in accordance with a current measurement signal dependent on the current through said first semiconductor switch.

4. The circuit configuration according to claim 1, including a current sensing resistor for providing a current measurement signal, said current sensing resistor being connected in series with said first semiconductor switch.

5. The circuit configuration according to claim 1, wherein said first semiconductor switch is a transistor.

6. The circuit conf iguration according to claim 1, wherein said first semiconductor switch is a field-effect transistor.

7. The circuit configuration according to claim 1, wherein said first semiconductor switch is an insulated gate bipolar transistor.

8. The circuit configuration according to claim 1, including:

a transistor having a third control electrode connected to said first control electrode;

said first semiconductor switch havin g a first load path terminal;

said transistor having a second load path terminal and a third load path terminal, said second load path terminal being connected to said first load path terminal; and a current sensing resistor connected downstream of said third load path terminal for providing a current measurement signal.

9. The circuit configuration according to claim 1, including an input terminal connected to said first control electrode and to said second control electrode.

10. The circuit configuration according to claim 1, including a control circuit connected to said first control electrode for driving said first semiconductor switch in dependence of a temperature in the circuit configuration.

11. The circuit configuration according to claim 10, wherein said control circuit includes a temperature-dependent switch connected between said first control electrode and a reference-ground potential.

12. The circuit configuration according to claim 10, wherein:

said control circuit includes a third semiconductor switch and a temperature sensor;

said third semiconductor switch is connected between said first control electrode and a reference-ground potential and has a third control electrode; and said temperature sensor is connected said third control electrode.

13. The circuit configuration according to claim 1, including:

a first chip having said first semiconductor switch integrated therein; and a second chip having said second semiconductor switch integrated therein.

14. The circuit configuration according to claim 2, including:

a first chip having said first semiconductor switch and said control circuit integrated therein; and a second chip having said second semiconductor switch integrated therein.

15. The circuit configuration according to claim 10, including:

a first chip having said first semiconductor switch and said control circuit integrated therein; and a second chip having said second semiconductor switch integrated therein.

16. The circuit configuration according to claim 13, including:

a housing;

a common support accommodated in said housing; and said first chip and said second chip being soldered onto said common support.

17. The circuit configuration according to claim 16, wherein said common support is a copper block.

18. The circuit configuration according to claim 1, including:

a first control circuit connected to said first control electrode for driving said first semiconductor switch in dependence of a current through at least one of the primary winding and said first semiconductor switch; and a second control circuit connected to said first control electrode for driving said first semiconductor switch in dependence of a temperature in the circuit configuration.

19. A circuit configuration for driving an ignition coil, comprising:

a first semiconductor switch having a first load path to be connected in series with a primary winding of an ignition coil and having a first control electrode for driving said first semiconductor switch in accordance with a first drive signal; and a second semiconductor switch having a second load path to be connected in parallel with the primary winding and having a second control electrode for driving said second semiconductor switch in accordance with a second drive signal.

* * * * *